US007194231B2

(12) United States Patent
Wu et al.

(10) Patent No.: US 7,194,231 B2
(45) Date of Patent: Mar. 20, 2007

(54) MAGNETIC ROLLER FOR IMAGE DEVELOPING MEANS

(75) Inventors: Tso-Lun Wu, Lujhu Township, Taoyuan County (TW); Cheng Lung Lee, Wugu Township, Taipei County (TW)

(73) Assignee: Proweal Counter Corp., Taipei County (TW)

( * ) Notice: Subject to any disclaimer, the term of this patent is extended or adjusted under 35 U.S.C. 154(b) by 164 days.

(21) Appl. No.: 10/866,027

(22) Filed: Jun. 14, 2004

(65) Prior Publication Data

US 2005/0276636 A1 Dec. 15, 2005

(51) Int. Cl.
*G03G 15/09* (2006.01)

(52) U.S. Cl. ..... 399/277

(58) Field of Classification Search ..... 399/252, 399/265, 267, 277; 492/8, 18, 52, 53, 59
See application file for complete search history.

(56) References Cited

U.S. PATENT DOCUMENTS 3,888,394 A * 6/1975 Tanaka et al. ..... 222/230
4,517,719 A 5/1985 Okumura
4,557,582 A 12/1985 Kan
4,597,661 A 7/1986 Yamashita
4,823,102 A * 4/1989 Cherian et al. ..... 335/306
4,872,418 A * 10/1989 Yoshikawa et al. ..... 399/277
5,030,937 A 7/1991 Loubier
5,129,358 A 7/1992 Myochin
5,758,242 A * 5/1998 Malespin et al. ..... 399/277
5,946,535 A * 8/1999 Aoki ..... 399/277
6,654,582 B2 11/2003 Jones
6,714,754 B2 3/2004 Ozeki

* cited by examiner

*Primary Examiner*—Hoan Tran
(74) *Attorney, Agent, or Firm*—Lowe Hauptman & Berner, LLP

(57) ABSTRACT

A magnetic roller for image developing of a printer and having a roller body made of rubber, plastic, or artificial resin mixed with magnetic materials and formed as unity, and a plurality of S magnetic poles and N magnetic poles, which are formed in the outer circle of the roller body as a unity.

10 Claims, 10 Drawing Sheets

MAGNETIC ROLLER FOR IMAGE DEVELOPING MEANS

BACKGROUND OF THE INVENTION

1. Field of the Invention

The present invention relates a magnetic roller for image developing means in electrophotographic system, and more particularly to a magnetic roller of image developing means that can largely reduce the cost of the magnetic rollers body, makes magnetic pole angle more accurate, and enhances the magnetic strength.

2. Description of the Prior Art

Accordingly, the image module of a laser printer, as shown in FIG. 1, includes: a photo-sensitive drum 11, which is a drum used to generate an electrostatic latent image on its surface; a corona bar 12, which is provided in one side of the surface of said photo-sensitive drum and used to distribute induction static electricity on the surface of said photo-sensitive drum; an exposure means 13, which is provided in another end away from said photo-sensitive drum and charging roller 12, and can receive the signal from an image reader to emit laser for exposure, so that an exposure area and non-exposure area similar to the image in the image reader are formed on the surface of photo-sensitive drum; a toner cartridge device 14, which is provided in another side of photo-sensitive drum in the backward position after exposure means is operated, used to provide storage of toner; a magnetic roller 15 with its surface covered by a developing sleeve, which is provided in front end of a toner cartridge outlet close to the photo-sensitive drum. The toners inside the cartridge device 14 are attracted by magnetic force of the magnetic roller 15 and distributed on the outer surface of developing sleeve 16, after the developing sleeve 16 keeps rotating and has induction with the exposure area having static electricity on the surface of photo-sensitive drum 11, toners are then attracted to the surface of photo-sensitive drum, and then, through the photo-sensitive drum 11, toners are brought to printing area. Afterwards, the toner transferring device 17 is used to transfer toners to adhere onto the surface of papers to form an image identical to the character or figure to the printed out. Then the image is obtained.

In the image developing means of printer described above, the quality of the magnetic roller has great impact on printing quality. In the conventional magnetic roller, as shown in FIG. 2, there is provided a non-conductive roller body 21, which is made of rubber, plastic or other artificial resins. A plurality of S magnetic poles 22*a*, 22*b*, etc., and N magnetic poles 23*a*, 23*b*, etc. are formed on the roller body 21 closed to the outer circular ring separately, usually in adjacent positions. Therefore, their magnetic poles can be arranged as even poles, such as dual poles, quad poles, six poles, or eight poles, etc. A conventional approach is to insert the magnetic bars with S magnetic poles and N magnetic poles in outer side into the roller body (disclosed in U.S. Pat. Nos. 4,517,719; 6,654,582). Another approach is to mix magnetic materials with rubber, plastic or other artificial resins to form a cylinder as a whole, using an exciter to excite the roller body in pre-determined outer parts of the roller body during forming the magnetic roller, so that a plurality of S magnetic poles and N magnetic poles are formed on the surface of the roller body opposite to the exciter (as shown in U.S. Pat. No. 5,129,358).

However, whether the S magnetic pole and N magnetic pole are formed by inserting the magnetic bars into the roller body or formed with the roller body as a whole, the entire cost of the magnetic roller is very high. This is because the materials of the roller body are very expensive and the technology that makes magnetic angle, magnetic strength, and magnetism equalization fit the need of printers is sophisticated. Moreover, if S magnetic poles and N magnetic poles are formed by inserting the magnetic bars into furrows formed on the surface of the roller body, this not only brings many problems with regards to density configuration, but also causes inconvenience on assembling. The problems regarding magnetic angle, magnetic strength, and magnetism equalization in each magnetic bar still need to be solved.

If S magnetic poles and N magnetic poles are formed on the adjacent edge of the whole roller body, some magnetic dipoles (small magnets) can not be exactly allocated in the position coherent to the magnetic flux, therefore, there are still some irregularly arranged magnetic dipoles (small magnets) 24 (as shown in FIG. 3) would be distributed aside the magnetic poles (as shown in area A, B, C, D of FIG. 3) and even central part of the roller body, causing the magnetic flux of S magnetic poles and N magnetic poles to be interfered, which affects the magnetic angle and magnetism equalization of magnetic poles and decreases magnetic strength, having impact on magnetic force configuration of the whole magnetic roller, making magnetization of the roller's magnetic materials incomplete. The satisfactory printing quality cannot be achieved because toners cannot be attracted on the accurate positions.

Accordingly, the present invention has been made for solving the above-mentioned problems occurred in the prior art.

SUMMARY OF THE INVENTION

Accordingly, the object of present invention is to provide a magnetic roller for image developing means in electrophotographic system. The magnetic roller for image developing means of printer according to the present invention is formed as an integral body. The magnetic roller is a non-cylinder body, and only S magnetic poles and N magnetic poles are formed in outward protruding status, so that the area between S magnetic poles and N magnetic poles can be largely curtailed and the cost of the magnetic roller can be largely reduced.

In the magnetic roller for image developing means in eletrophotographic system according to the present invention, since magnetic poles are formed in outward protruding status, and the area between S magnetic poles and N magnetic poles is largely curtailed, as a result, magnetic flux of magnetic poles can be more concentrated during magnetic excitation. In magnetic roller the magnetic dipoles (shown as small magnets) those are arranged irregularly and thus (cause) the interference of magnetic poles would be decreased. Therefore, magnetic flux of S magnetic poles and N magnetic poles can be increased, the effect of attracting toner can be enhanced, and printing quality can be further enhanced. This is the another object of the present invention.

The magnetic roller for image developing means of printer according to the present invention, with the position of S magnetic poles and N magnetic poles are fixed, the magnetic angle is then fixed, so that the accuracy of magnetic angle can be enhanced. This is further object of the present invention.

The above objects and other advantages of the present invention will become more apparent by describing in detail the preferred embodiment of the present invention with reference to the attached drawings.

DETAILED DESCRIPTION OF THE PREFERRED EMBODIMENTS

Figure 1:
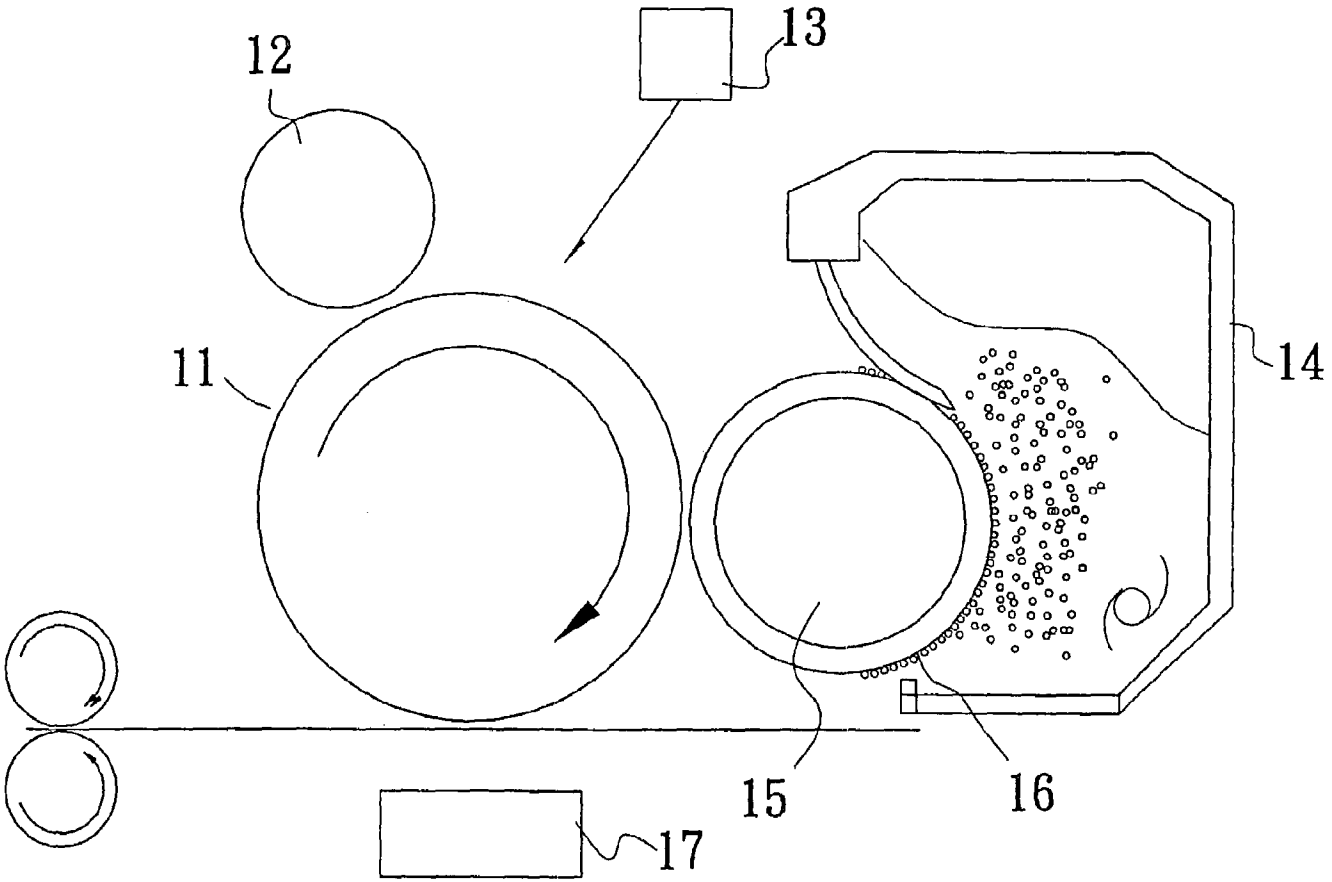
FIG. 1 PRIOR ART
FIG. 1 is a drawing showing the configuration of a conventional magnetic roller for image developing means in electrophotographic system.
Figure 3:
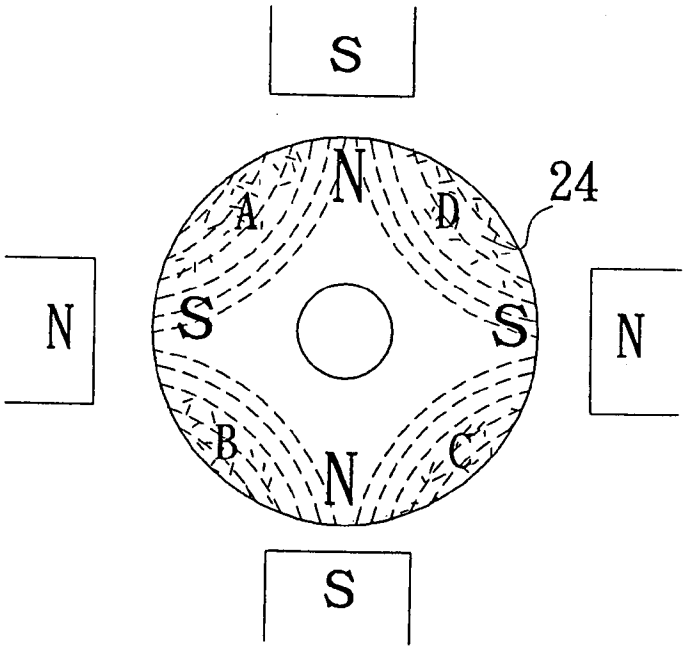
FIG. 3 PRIOR ART
FIG. 3 is a plane view of a conventional magnetic roller showing the magnetic flux between magnetized magnetic poles of the magnetic roller and magnetic poles ordering means.
Figure 2:
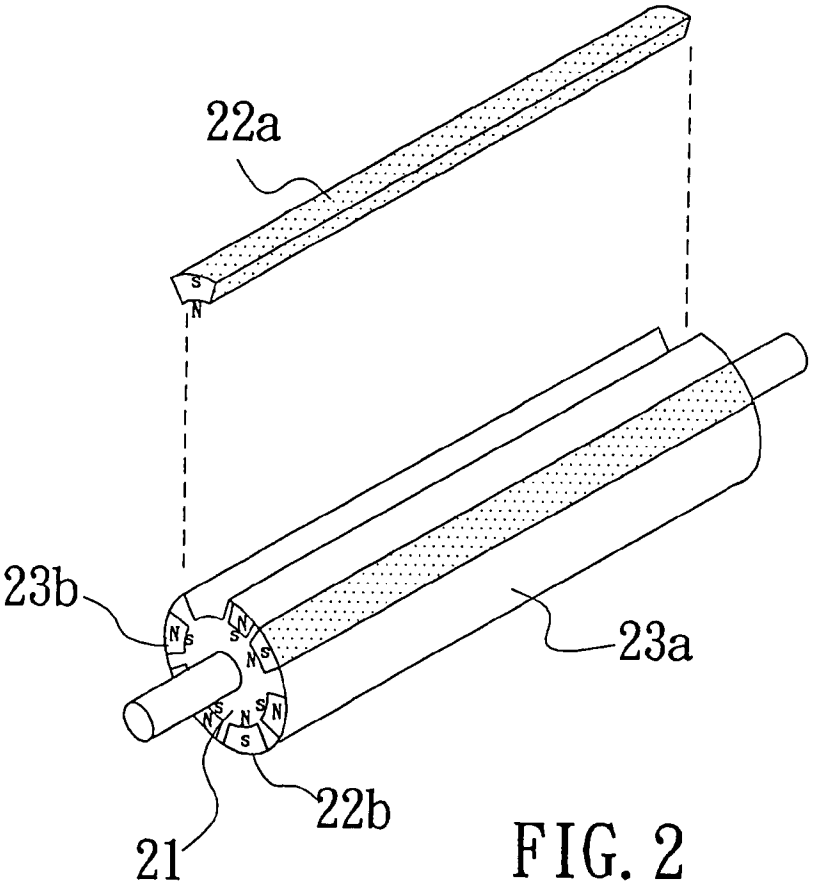
FIG. 2 PRIOR ART
FIG. 2 is a perspective view of a conventional magnetic roller for image developing means in electrophotographic system.
Figure 5:
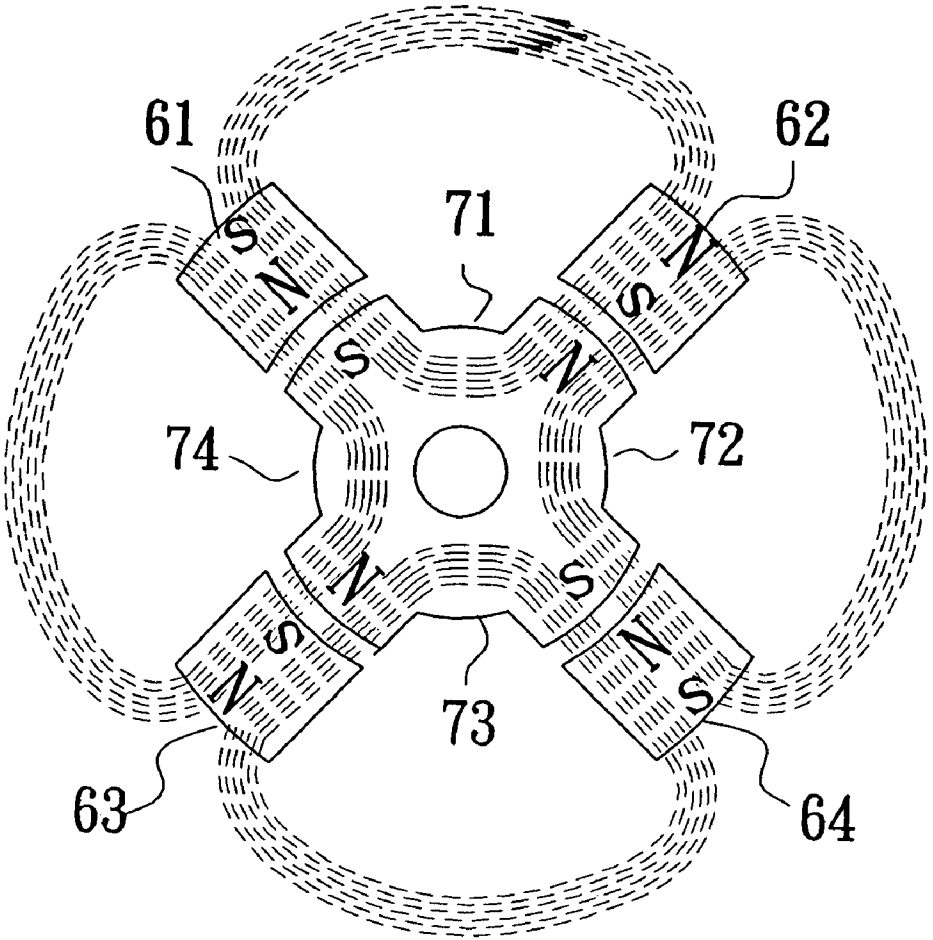
FIG. 5 is a plane view of the magnetic roller according to the present invention.
Figure 4:
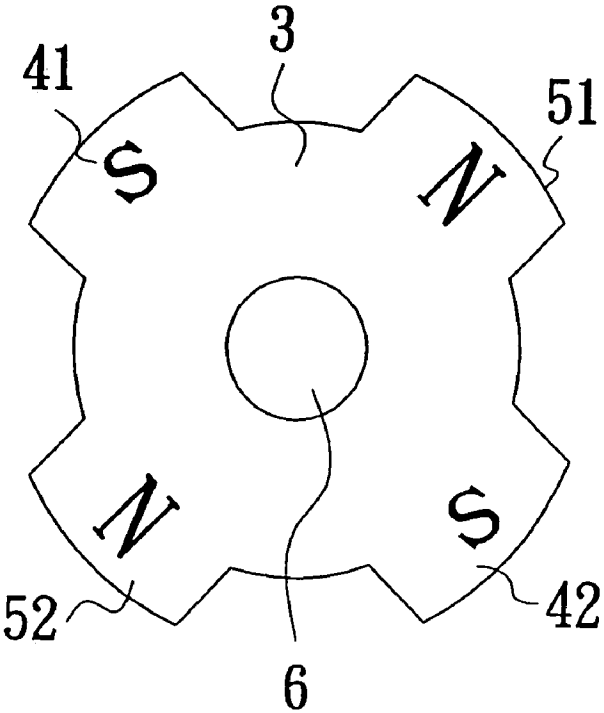
FIG. 4 is a drawing showing magnetic excitation to form the magnetic roller according to the present invention.
Figure 6:
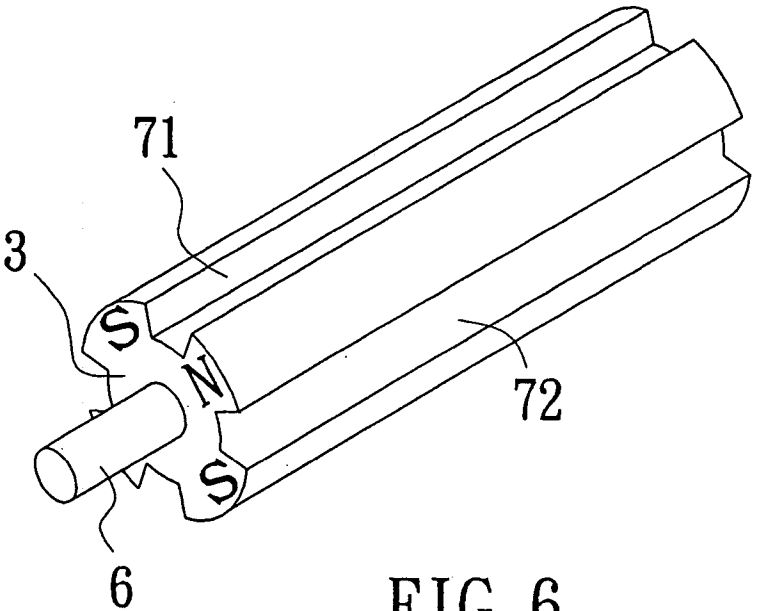
FIG. 6 is a perspective view of the magnetic roller of printer image developer of in the present invention.

As shown in FIGS. 4, 5, and 6, the magnetic roller for image developing means of the present invention in electrophotographic system includes a cylindrical roller body 3, which is made of rubber, plastic or other artificial resins mixed with magnetic materials as a unity.

A plurality of S magnetic poles 41, 42 and N magnetic poles 51, 52 on the outer surface of roller body 3 are protruded outward from the center of the roller body 3, so that S magnetic poles 41, 42 and N magnetic poles 51, 52 form strip shape in the direction of the axis of roller body; and an axis of roller 6, which is passed through the center of the roller body.

Wherein, said plurality of S magnetic poles 41, 42 and N magnetic poles 51, 52 are formed after roller body 3 is manufactured by injection, compression, or extrusion process and before the process of curing, using a plurality of exciting devices 61, 62, 63, 64 to excite the protruding part of the magnetic roller respectively, so that S magnetic poles and N magnetic poles are formed on the protruding part respectively. The roller body formed by this way is a magnetic roller with outward protruding S magnetic poles 41, 42 and N magnetic poles 51, 52. Such a magnetic roller is a non-circular body in a unity, and the areas 71, 72, 73, 74 between S magnetic poles and N magnetic poles are hollow in inner indentation status.

Figure 7:
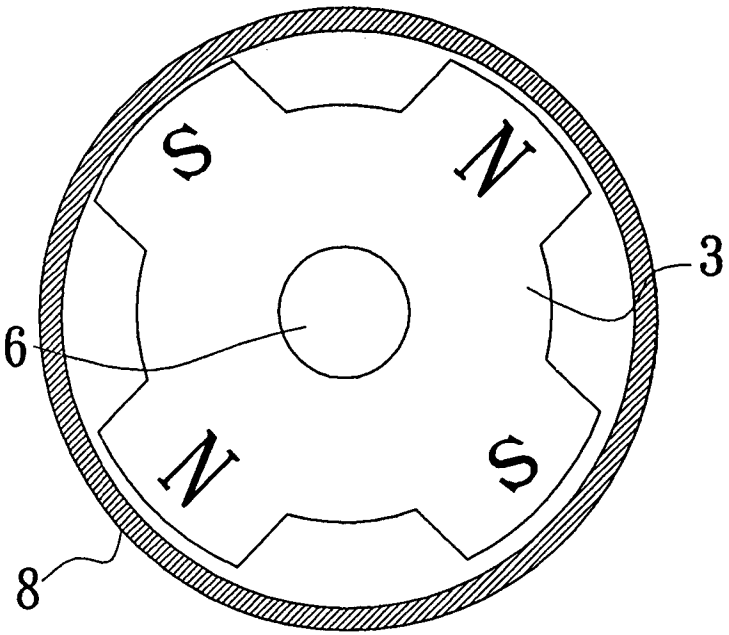
FIG. 7 is a plane view of the magnetic roller in the present invention having a sleeve on it.
Figure 8:
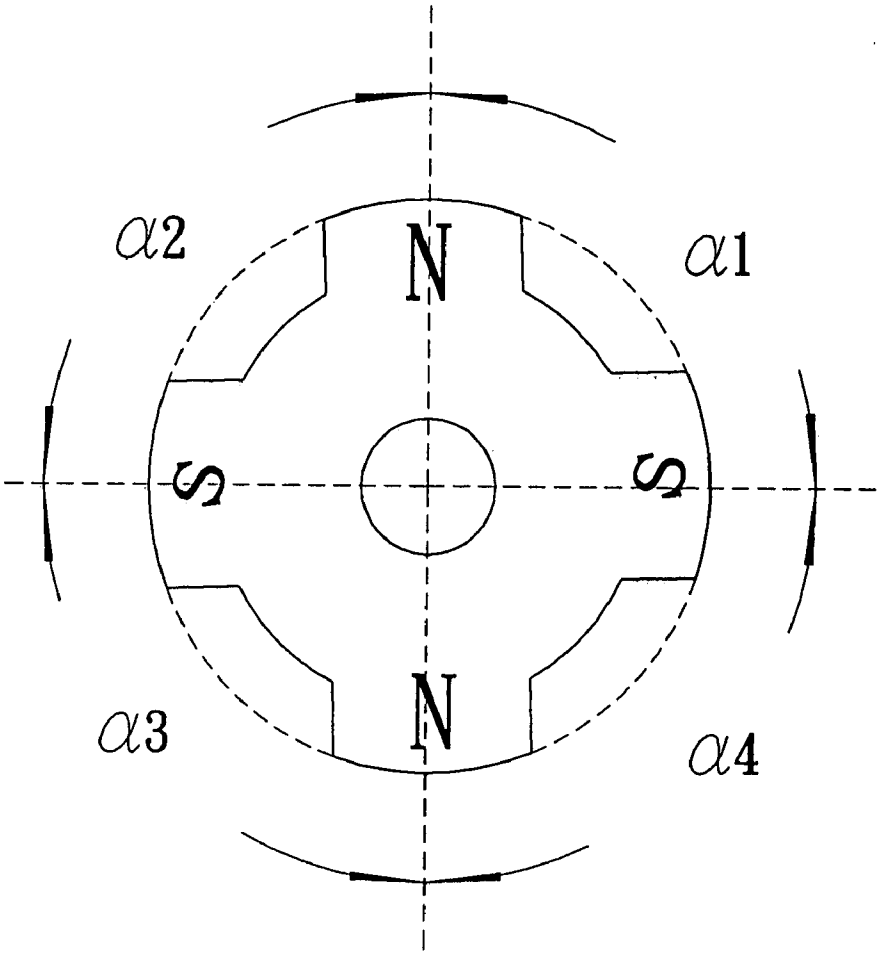
FIG. 8 is a drawing illustrating how the magnetic roller of the present invention saves the cost of materials.

As the above-mentioned magnetic roller is implemented in image developing means (i.e. printer), as shown in FIG. 7, the roller body is covered by a developing sleeve 8, since the areas 71, 72, 73, 74 between S magnetic poles 41, 42 and N magnetic poles 51, 52 are in indentation status, the entire expensive materials of the magnetic roller can be largely reduced and the cost of the magnetic roller can be largely reduced (as shown in FIG. 8). Furthermore, since these areas are non-magnetic in concave area, magnetic flux between magnetic poles will not be interfered, thus the magnetic strength of magnetic poles in the magnetic roller can be largely increased. Furthermore, since the position of magnetic poles is fixed, the effect that makes magnetic angle more accurate can be achieved.

Figure 10:
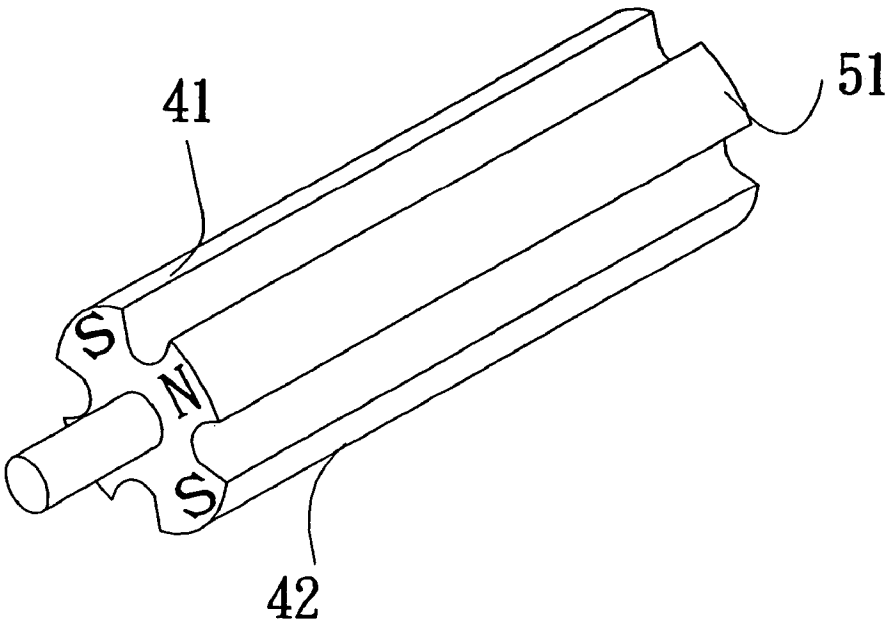
FIG. 10 is a perspective view of another embodiment of the magnetic roller in the present invention shown in FIG. 9.
Figure 9:
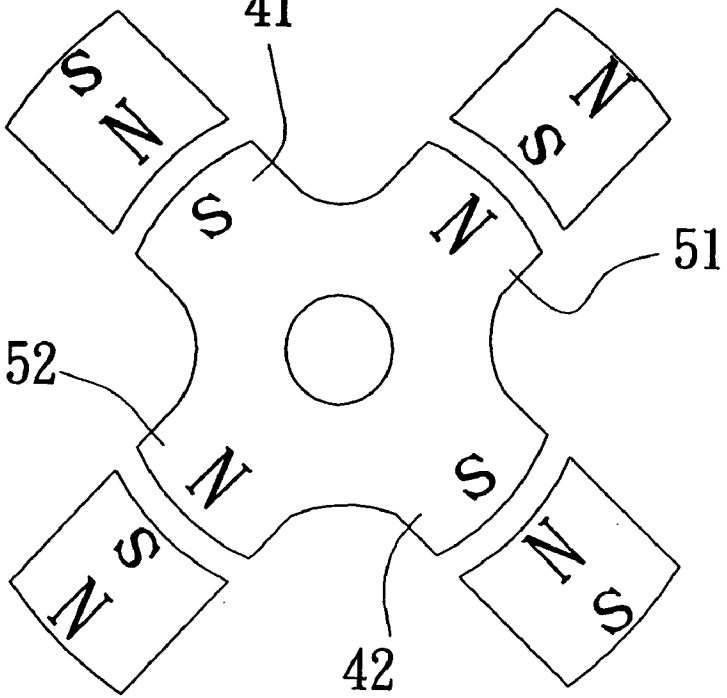
FIG. 9 is a drawing showing another embodiment of the magnetic roller in the present invention.

In another embodiment of the present invention, as shown in FIGS. 9 and 10, when S magnetic poles 41, 42 and N magnetic poles 51, 52 are in outward protruding status, the magnetic flux is oriented along with the indentation arc between two adjacent magnetic poles. Therefore, when using the exciting devices to magnetize the magnetic poles in the protruding part of the roller body, the S magnetic poles and N magnetic poles are magnetized in fixed angles. These angles between S magnetic poles and N magnetic poles can be equalized or not. Since the magnetic flux between two adjacent magnetic poles are coherent with the inner indentation arc of the magnetic roller, irregular arrangement of magnetic dipoles (small magnets) can be greatly decreased and magnetic strength of the magnetic roller can be largely enhanced.

In addition, since the position of magnetic poles is fixed, magnetic angle of the magnetic roller can be more accurate. In the magnetic roller of the embodiment, the more magnetic flux is oriented into the central part of the roller, the more effective the magnetization of the material is. Since the convex parts are extruded outward in fixed angles, thus the magnetic flux can be more concentrated, the magnetic strength are enhanced, and the materials saved have been increased than the prior embodiment, thus promoting large cost down.

Figure 11:
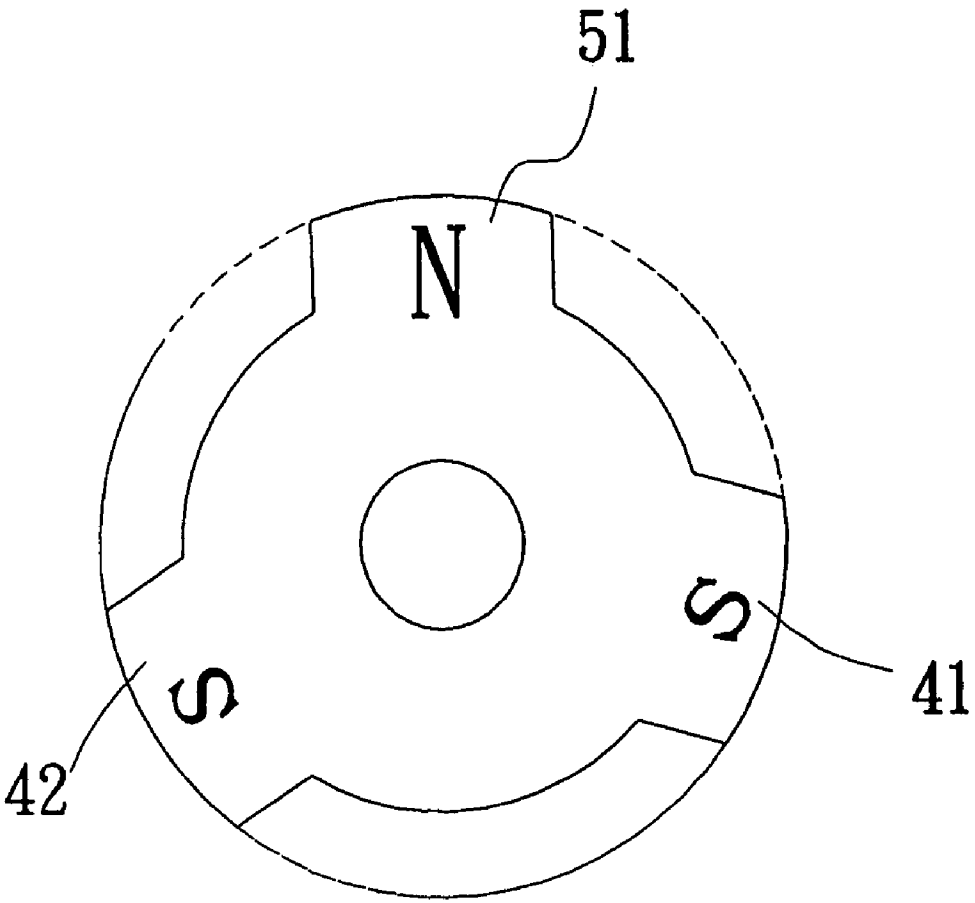
FIGS. 11 to 14 are drawings illustrating other embodiments of the magnetic roller of present invention.

In the magnetic roller of the present invention, as S magnetic poles and N magnetic poles can be paired or not paired (as shown in FIG. 11), the magnetic poles can be even poles, such as dual poles, quad poles, six poles, etc. or in odd numbers, while the surface of roller body 3 and magnetic poles 41, 42, 51, 52 are in arc shape (with same or different curvatures) or not in arc shape.

Figure 12:
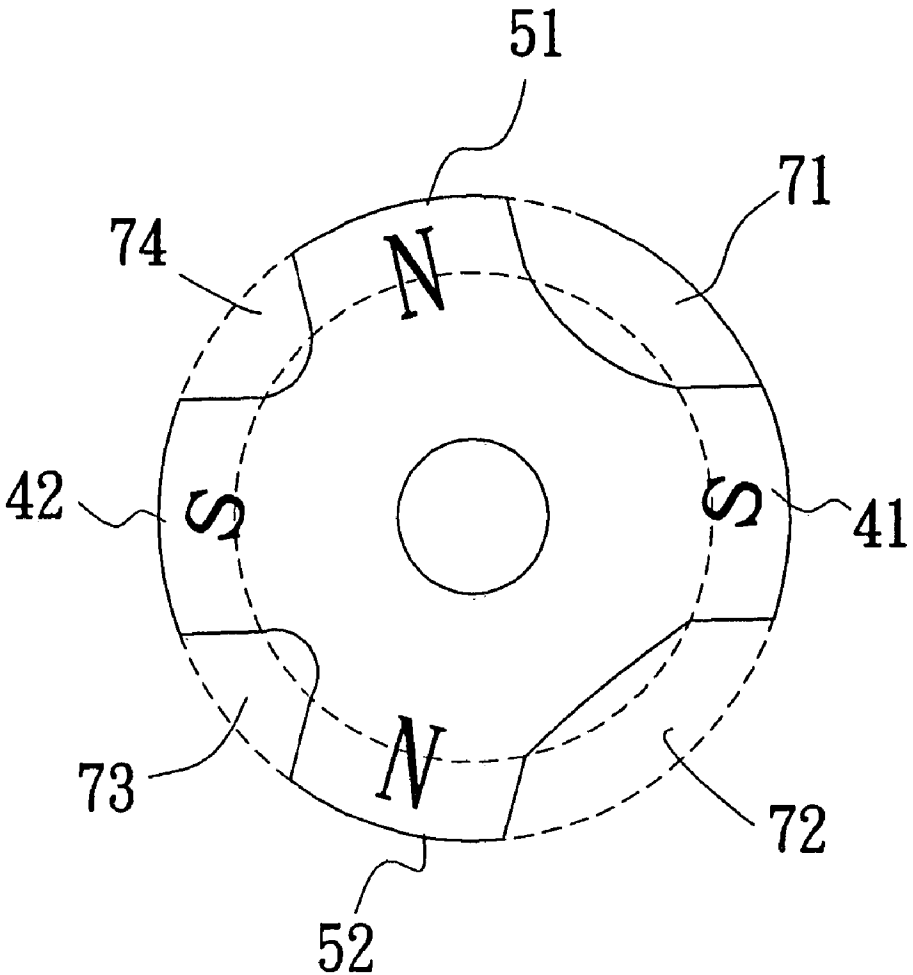
Figure 13:
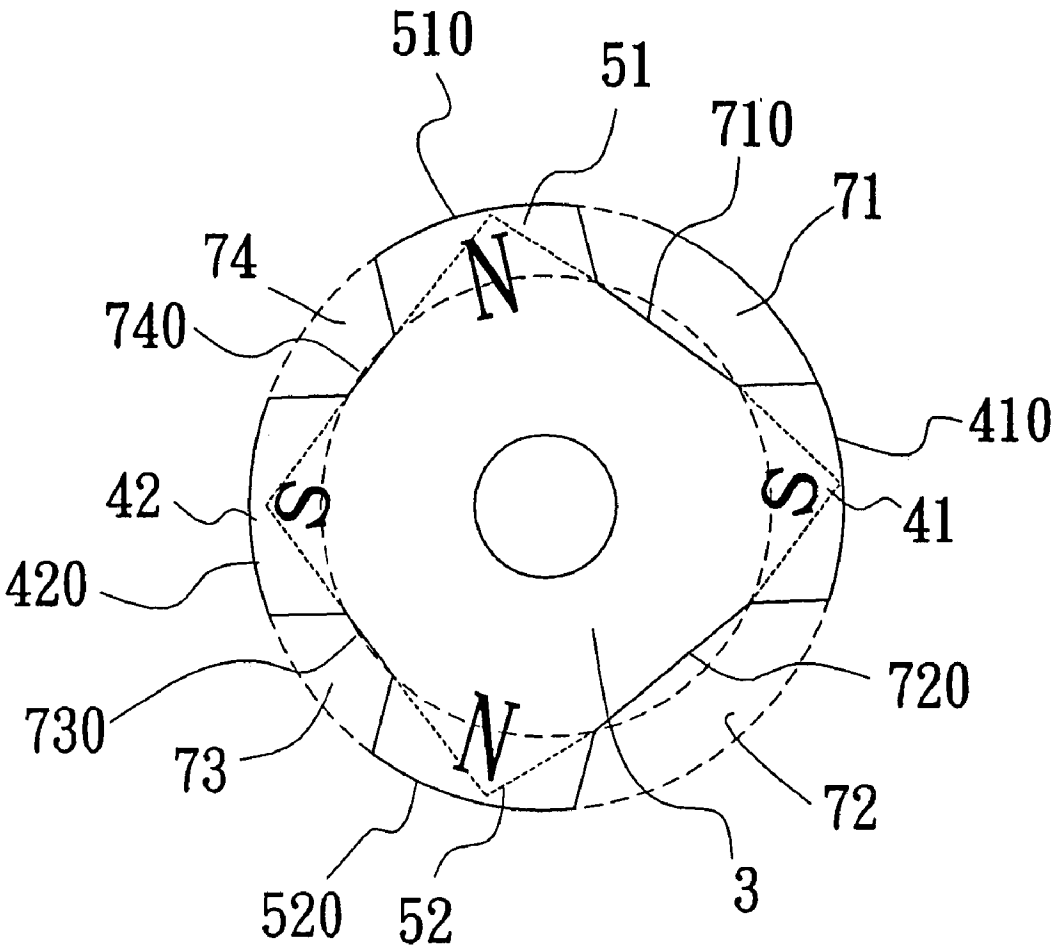

For example, as shown in FIG. 12, for different necessities, the open angles $\alpha 1$, $\alpha 2$, . . . between two adjacent magnetic poles can be different. Therefore the concave areas 71, 72, 73, 74 between two adjacent magnetic poles can be formed into different areas. Moreover, as shown in FIG. 13, for processing convenience and to reduce production cost, each of the surfaces 710, 720, 730, 740 of roller body 3 between two adjacent magnetic poles, even each of the surfaces 410, 420, 510, 520 of magnetic poles 41, 42, 51, 52 can be formed into a plane.

Figure 14:
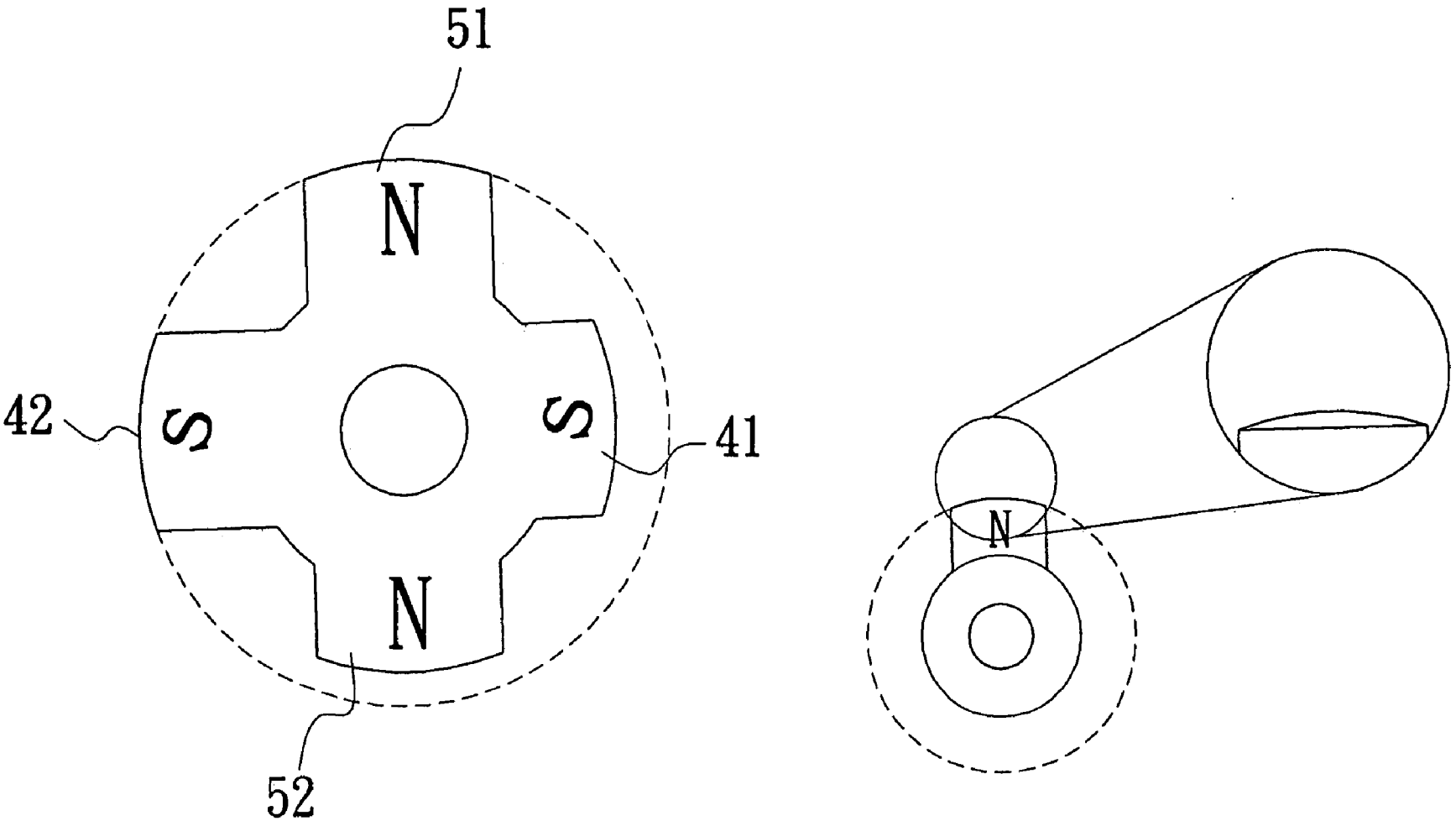

In addition, for special uses and other considerations, for example, in order to obtain different flux densities, as shown in FIG. 14, the protruded heights of the magnetic poles 41, 42 . . . of the magnetic roller of present invention can be different.

In conclusion from above, according to the magnetic roller for image developing means of the present invention in a electrophotographic system, by making the magnetic roller formed as a non-cylinder body in a unity and only S magnetic poles and N magnetic poles are in outward protruding status, so that the area between two magnetic poles is in inner indentation status, which effectively makes magnetic angle of the magnetic roller more accurate, enhances magnetic strength, and largely reduces the cost of magnetic roller. Also, the present invention has not yet opened to public, it is then complied with the conditions of allowable patents.

Although the above-mentioned embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A magnetic roller for image developing means in electrophotographic system, comprising: a roller body, which is made of rubber, plastic, or other artificial resin mixed with magnetic materials as a unity; and an axis of roller which passes through the center of the roller body; characterized in that: a plurality of S magnetic poles and N magnetic poles are protruded outward to form on outer ring of the roller body, and the areas between two adjacent magnetic poles are in inner indentation status, and wherein the base of the two adjacent magnetic poles in said roller body is connected with the convex arc surface.

2. The magnetic roller for image developing means as claimed in claim 1, wherein the base of the two adjacent S and N magnetic poles in said roller body is connected with the concave arc surface.

3. The magnetic roller for image developing means as claimed in claim 2, wherein the base of the S magnetic pole is an arc within the same curvature as that of the N magnetic pole.

4. The magnetic roller for image developing means as claimed in claim 1, wherein the surface between two adjacent S and N magnetic poles in said roller body is formed into a plain surface.

5. The magnetic roller for image developing means as claimed in claim 1, wherein the surface of the S and N magnetic pole are arc shaped with the same curvature.

6. The magnetic roller for image developing as claimed in claim 1, wherein the surface of S or N magnetic pole is an arc with the different curvature.

7. The magnetic roller for image developing as claimed in claim 1, wherein the surface of S or N magnetic poles is plain.

8. The magnetic roller for image developing as claimed in claim 1, wherein the protruding height of the magnetic pole are similar.

9. The magnetic roller for image developing as claimed in claim 1, wherein time protruding heights of the S and N magnetic poles are different.

10. The magnetic roller for image developing means as claimed in claim 1, wherein the surface of the S magnetic pole is an arc with the same curvature as that of the N magnetic pole.

* * * * *